US005169121A

United States Patent [19]

Blanco et al.

[11] Patent Number: 5,169,121

[45] Date of Patent: Dec. 8, 1992

[54] DAMPER CONTROL MECHANISM

[75] Inventors: Ernesto E. Blanco, Belmont, Mass.; Peter F. Thompson, Cypress, Calif.

[73] Assignee: Mitsubishi Electronics America, Inc., Cypress, Calif.

[21] Appl. No.: 633,147

[22] Filed: Dec. 24, 1990

[51] Int. Cl.[5] ..... F16K 31/66; F16K 31/04

[52] U.S. Cl. ..... 251/129.12; 251/305; 200/47; 200/61.39; 200/574; 310/68 B; 310/83

[58] Field of Search ..... 251/129.11, 129.12, 251/305, 308, 89, 248, 251; 74/412 A; 236/49.3; 200/47, 61.39, 574; 310/68 B, 83

[56] References Cited

U.S. PATENT DOCUMENTS

| | | | |
|---|---|---|---|
| 2,868,911 | 1/1959 | Wilhelmson | 200/61.39 |
| 2,871,327 | 1/1959 | Jones | 200/61.39 |
| 2,977,437 | 3/1961 | Doane | 251/129.12 |
| 3,165,291 | 1/1965 | Osen | 251/129.12 |
| 3,282,557 | 11/1966 | Capps | 251/129.12 |
| 3,430,916 | 3/1969 | Raymond, Jr. | 251/129.12 |
| 3,825,182 | 7/1974 | Bauchmann | 251/129.12 |
| 3,870,274 | 3/1975 | Broe | 251/129.12 |
| 3,930,133 | 12/1975 | Sulzer | 310/68 B |
| 4,050,000 | 9/1977 | Sutter | 200/61.39 |
| 4,193,541 | 3/1980 | Scheidweiler | 251/129.12 |
| 4,533,800 | 8/1985 | Parsons | 200/61.39 |

FOREIGN PATENT DOCUMENTS

| | | | |
|---|---|---|---|
| 1111893 | 7/1961 | Fed. Rep. of Germany | 251/129.12 |
| 193710 | 1/1938 | Switzerland | 251/129.12 |

*Primary Examiner*—George L. Walton
*Attorney, Agent, or Firm*—Alan B. Samlan

[57] ABSTRACT

An air control damper assembly for mounting in an air duct comprising a damper blade pivotally mounted within the air duct and means for rotating the damper blade from an open position to a close position. A drive system rotates the damper blade such that the system exerts a high torque and low speed at the beginning and end of the rotation of the blade from one position to the other and a low torque and high speed in the middle of the rotation of the blade between positions. The damper blade is locked in the open and close positions by means of a motor and gear unit. Electrical switches interfacing with a drive disk in the drive system partially controls the energization of the motor.

18 Claims, 2 Drawing Sheets

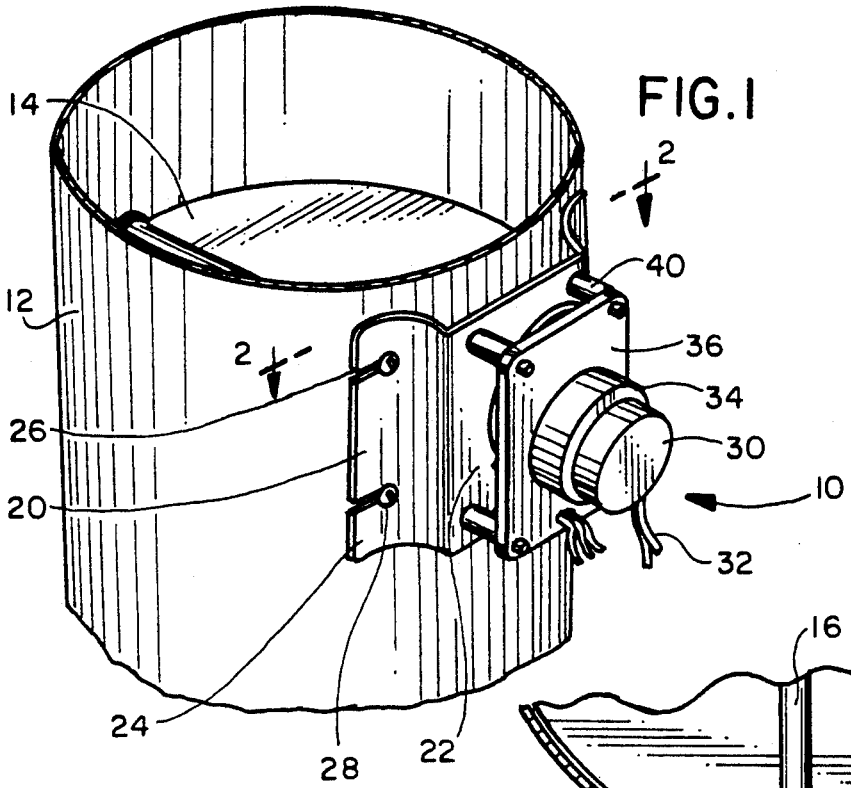
FIG. 1
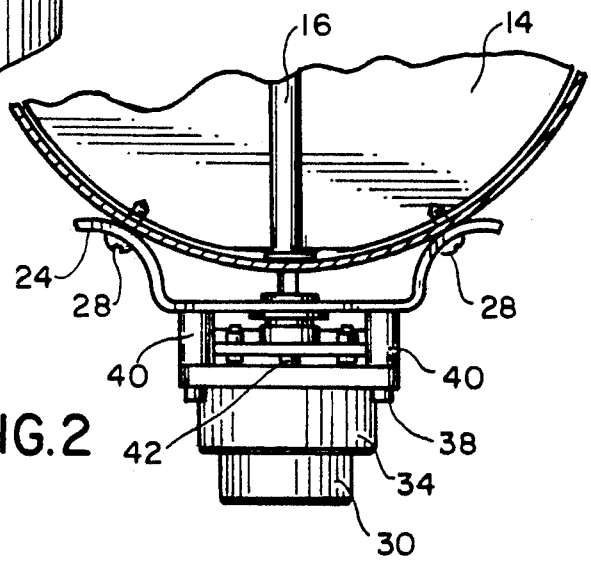
FIG. 2
FIG. 3
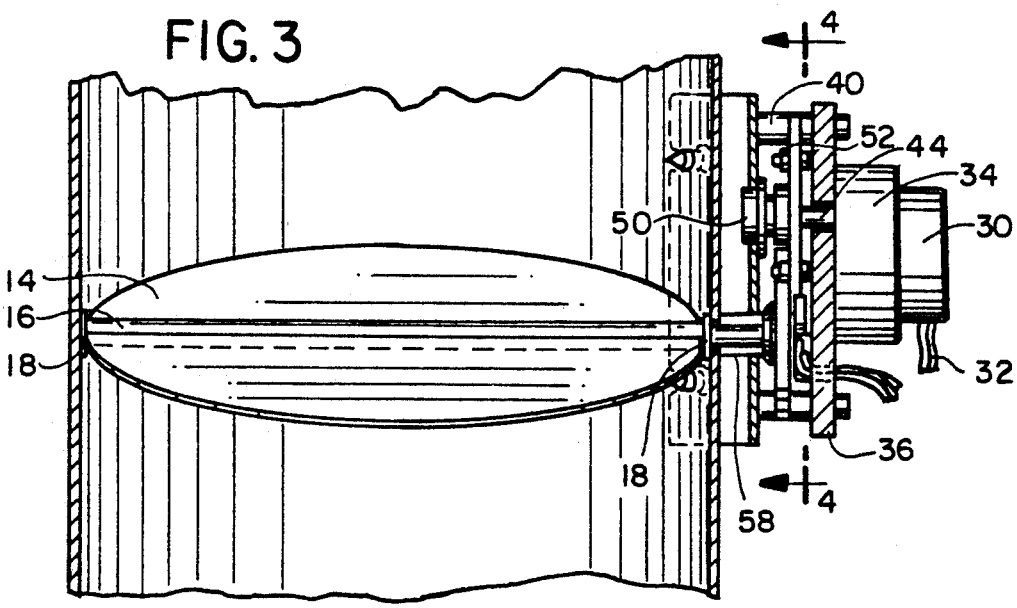

DAMPER CONTROL MECHANISM

BACKGROUND OF THE INVENTION

This invention relates to air control dampers and more particularly to an air control damper in a zoned air conditioning system.

The inventive damper assembly is particularly well suited for the residential heating, ventilating and air conditioning ("HVAC") market. It is particularly well suited for the home retrofit market although it could also be applied in new construction or in smaller commercial applications.

Generally, residential HVAC systems heat or cool the air which is discharged at constant pressure and at constant air quality by the blower and distributed to the respective rooms through the respective branched ducts, so that each room is cooled or warmed. Therefore, when the quantity of air for a particular room is to be reduced by a damper in order to lower the temperature of the room when the system is in the heating configuration, the quantity of air which is distributed to other rooms increases so that the temperature in the other rooms also changes.

There have been various systems which provide for the zoned control of HVAC systems for home applications. One example is in U.S. Pat. No. 4,243,174 which provides for the automatic opening and closing of electrically operated dampers to control the air flow into a series of rooms. The motor operated damper utilizes a solenoid to rotate the damper assembly. However, this motor operated damper assembly utilizes a linkage and spring assembly to open and the close the damper when the solenoid is operated. The disadvantage of this damper assembly is that it does not securely lock the damper in the opened or closed position and may inadvertently rotate from the desired position due to the flow of air or lack thereof. Furthermore, the mechanism is not adapted to be mounted on ducts of varying size or configuration. It appears that the solenoid is directly fasten to the air duct which on larger diameter air ducts would be acceptable, but on the small diameter air duct the solenoid would not be able to be securely fastened to the duct without a suitable adaptor.

Another example of a zoned HVAC system which utilizes air control mechanisms in the ducts is illustrated in U.S. Pat. No. 4,600,144. In this patent there is illustrated a bladder-type flow control device which, when inflated, blocks off air flow through the duct. Other forms of duct control mechanisms are illustrated in this patent, one of which utilizes a standard mechanical damper which limits the air flow through the duct. However, none of these dampers assemblies employ a motor control mechanism which securely locks the damper in place in the opened or closed position.

OBJECTS AND ADVANTAGES

Accordingly, it is an object of the present invention to provide an air control damper assembly that has a damper blade mounted within the air duct and a controller for causing the damper blade to operate between an opened and closed position. Related to this object is the object of providing an air control damper assembly which has a motor and gear unit which drives the damper blade from its opened to closed positions with a high torque and low speed at the beginning and end of the cycling from one position to the other and a low torque and high speed in the middle of the cycle as the blade travels between positions.

Yet another object is the object of providing a damper blade which is locked in the opened and closed positions by means of the motor and gear unit.

Still another object is the object of providing an air control damper assembly having a unique drive system which drives the damper blade from the opened to closed position at a non-constant speed. Related to this object is the object of providing an air control damper assembly which has a control circuit to control power to the motor and gear unit whereby energization of the motor is controlled by the position of the damper blade.

These and other objects and advantages will become apparent upon reading the brief description of the drawings and the detailed description of the preferred embodiment.

BRIEF DESCRIPTION OF THE DRAWINGS

FIG. 1 is a perspective view with portions removed of an air duct having the motor and drive mechanism mounted to the duct.

FIG. 2 is a plan view taken along line 2—2 of FIG. 1.

FIG. 3 is a side view partially in cross section with portions removed showing the drive system connected to the damper blade and the mounting bracket which mounts the drive mechanism to the air duct.

DESCRIPTION OF THE PREFERRED EMBODIMENT

Figure 4:
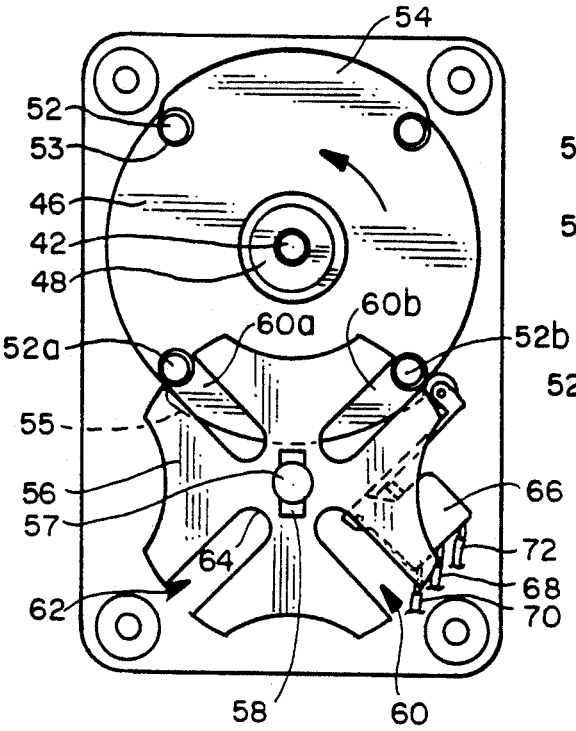
FIG. 4 is an end view taken along the axis of the gear output shaft and taken along line 4—4 of FIG. 3, showing the relationship between the drive disk and starwheel, and further showing the cam surface of the drive disk as it interacts with the switch arm of the micro switch.

The present invention is particularly well suited for residential heating and cooling systems utilizing zoned control. The air flow to each zone is controlled by a motorized damper assembly 10 of the present invention. The instant invention is particularly well suited for using standard air ducts, refrigerant lines and wiring. By providing the motorized damper assembly 10 for each zone, each zone can be controlled by its own thermostat set to a different temperature.

Turning to FIG. 1, the motorized damper assembly 10 is mounted on an air duct 12 of cylindrical configuration. The air duct 12 can be of any one of a number of standard available air ducts which may have a rectangular cross sectional area. A damper blade 14 is mounted on a blade shaft 16 which extends across the air duct 12. The blade shaft 16 is mounted in bearings 18 which permit the blade shaft 16 to freely rotate within the duct 12.

In order to provide for mounting the motorized assembly 10 on various dimensioned and configured air ducts 12 a universal mounting bracket 20 is utilized. The bracket 20 has a centralized flat portion 22 which has at its outer edges curved mounting portions 24. Slots 26 are cut into the curved mounting portion 24 and have a width of sufficient diameter to allow sheet metal screws 28 to be received therein. Thus, depending on the configuration of the air duct 12, the sheet metal screws 28 will pass through the slots 26 and into the air duct 12. The location of the sheet metal screws 28 in the slots 26 will depend upon the configuration of the air duct 12. As seen in FIG. 2, with a cylindrical air duct, the screws 28 will pass through the curved mounting portion 24 and be received by holes drilled in the air duct 12. If the air duct 12 was rectangular, and the mounting bracket 20 was being affixed to a flat surface on the air duct, the sheet metal screws 28 would be located approximately at the end of the mounting portion 24 such that the end of the curved mounting portion 24 would be substantially flush against the flat surface of the air duct 12. With this type of a universal mounting bracket 20, the motorized damper assembly 10 can mounted on an air duct 12 of all most any standard available configuration.

In FIGS. 1 through 3, the major components of the motorized damper assembly 10 can be identified. There is an alternating current motor 30 which is preferable operated at 24 volts AC, 60 hertz. The motor is connected to the power source by means of motor leads 32 which are connected into the motor control circuit. The motor 30 is mounted to and drives a gear assembly 34. The output of the gear assembly is approximately ½ revolution per minute. The motor and gear assembly can be purchased as a standard available singular unit. The motor and gear assembly are mounted on a mounting plate 36. The mounting plate 36 is in turn securely fastened to the flat portion 22 of the mounting bracket 20 by means of the screws 38. Spacers 40 keep the mounting plate 36 in a spaced parallel relationship with the flat portion 22. The spacers 40 may have a threaded central passageway to receive the screws 38 if the spacers are firmly mounted to the flat portion 22. Alternatively, the screws 38 may merely pass through the spacers 40 and be fasten to the flat portion 22 by means of nuts (not illustrated).

The gear assembly 34 has a gear assembly output shaft 42 which extends through a passageway 44 in the mounting plate 36. Mounted on the output shaft 42 is a drive disk 46 having a spacing hub 48 which can be either part of the drive disk 46 or a separate element and which is used to maintain a gap between the flat portion 22 of the mounting bracket 20 and the drive disk 46. The end of the gear assembly output shaft 42 opposite the gear assembly 34 rests in a bearing 50. The output shaft 42 is keyed so that the drive disk 46 can be locked to and securely driven by the output shaft 42. Also as can be more clearly seen and FIG. 4, there are four drive pins 52 equally spaced and at 90 degrees with respect to each other and mounted adjacent to the circumferential edge of the drive disk 46. The drive pins 52 can have a roller surface 53 securely mounted on to the drive pin 52.

The drive disk 46 has two cam surfaces 54 and 55 opposite each other. Each cam surface 54 and 55 extends along the circumferential edge of the disk 46 between two drive pins 52. This divides the circumferential edge of the disk 46 into four equal quadrants.

As can be seen in FIGS. 3 and 4, a starwheel 56 is mounted below the drive disk 46. The starwheel 56 is mounted on a shaft 57 which is secured to the mounting plate 36. The starwheel 56 is free to rotate on the shaft 57. Extending away from the mounting plate 36 and towards the air duct 12 is a starwheel coupling 58 which connects the starwheel 56 to the blade shaft 16.

The starwheel 56 has four equally spaced radial slots 60 disposed in pairs opposite each other. The radial slots 60 have an open end 62 at the circumferential edge of the starwheel 56 and terminate in a u-shaped bottom 64 towards the center of the starwheel 56.

Figure 5:
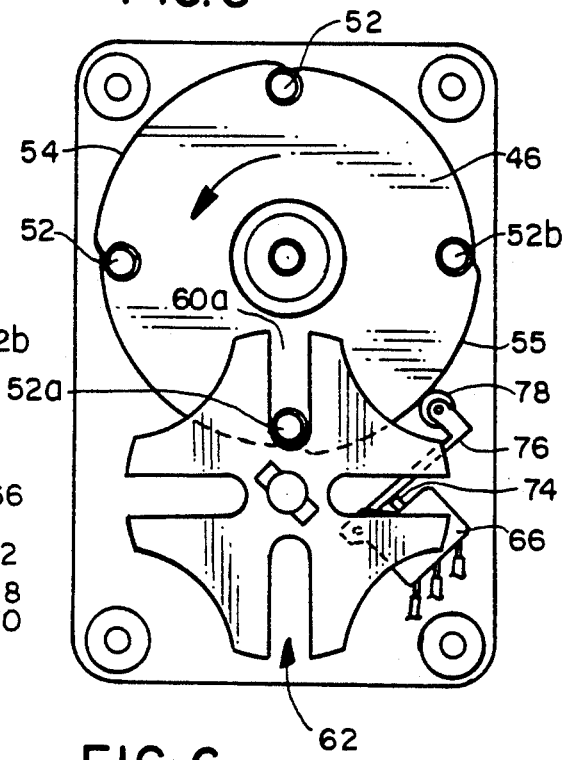
FIG. 5 is similar to FIG. 4 with the drive disk being rotated approximately 45 degrees.

As can also be seen in FIGS. 4 and 5, a single pole double throw electrical micro switch 66 is mounted to the mounting plate 36. The switch 66 has three leads extending from it. There is a common lead 68, a close lead 70 and an open lead 72. Also extending from the switch 66 is a spring loaded finger 74 which is actuated by a switch arm 76. At the end of the switch arm 76 is a roller cam follower 78 which rides along the circumferential edge of the drive disk 46 and follows the contour of the peripheral surface. The cam surfaces 54 and 55 cause the cam follower 78 to push the switch ar 76 which in turn pushes the spring loaded finger 74 and opens or closes the respective contacts in the electric switch 66. This in turn opens or closes the control circuits connected to leads 68, 70 and 72.

To operate the damper assembly 10 a command signal to open the damper is given by applying 24 volts power between the lead 68 (common) and lead 72 (open). The motor 30 is activated and the gear assembly output shaft 42 drives the drive disk 46. Drive pin **52*a* in FIG. 4 engages the wall of slot 60*a*. The pin 52*a* initially engages the slot 60*a* while the slot's orientation is tangential to the path of the pin which results on a smooth and gradual acceleration of the starwheel 56. At the same time as pin 52*a* is engaging slot 60*a*, pin 52*b* is exiting from slot 60*b***.

The mid point of the opening cycle is illustrated in FIG. 5. In this configuration the damper blade 14 will be in its mid position between the close and open positions. Also it can be seen that the pin **52*a* is pushing in a perpendicular direction against the wall of the slot 60*a*. At the mid point the starwheel 56 and the damper blade 14 will be driven at the maximum speed and minimum torque due to the configuration of the pins 52 and the manner in which they engage the slots 60. At the beginning of the engagement of the slot 60 by the pin 52, the drive has its minimum output speed and maximum torque. This is the exact design characteristics which are required in a damper assembly. When the damper blade is fully closed, the drive system must overcome the forces of the air exerted against the damper blade in the air duct 12. Similarly, it is desired to have a maximum torque condition to retain the damper blade 14** in its open or close position.

As the opening cycle continues and the drive disk 46 continues to rotate, the roller cam follower 78 will drop off the cam surface 55 into the recessed area between cam surfaces 54 and 55 on the perimeter of the drive disk 46. This causes the electrical switch 66 to open the circuit which stops the motor 30. Although power may remain at the lead 68 indefinitely, power to lead 70 or 72 is controlled by the condition of the switch 66 and nothing happens since current flow to the motor is interrupted by the electrical switch. In this stopped position, no amount of torque applied at the output blade shaft 16 can possibly drive the gear assembly 34 and motor 30 backwards. The drive system is for all practical purposes completely locked. This results in the ideal design for the damper blade 14 which is subjected to flow fluctuations and flutter.

To close the damper blade 14 the 24 volt power input is applied between the leads 68 (common) and 70 (closed). The motor will be activated again and the interaction between the drive pins 52 and the slots 60 in the starwheel 56 will be repeated. The damper blade 14 will rotate 90 degrees to close the flow path in the air duct 12. The lead edge of the cam surface 54 on the drive disk 46 will activate the cam follower 78 on electrical switch 66 to interrupt the motor circuit at the time when the drive pins 52 assume the position shown in FIG. 4. This position has one of the drive pins exiting the slot 60 while a second pin is engaging the next radial slot 60. The sequence of operation is repeated for each 90 degree cycle.

The sequence of operations described above are positive, repetitive and reliable. They do not depend on speed, friction, elapsed time or override at the motor. The entire sequence is controlled by the action of the cam surfaces 54 and 55 interacting with the electrical switch 66. Since the position of the starwheel 56 at the end of each cycle is almost insensitive to variations in the position of the drive pins 52, the damper blade 14 will precisely be either fully opened of fully closed a the end of each completed command cycle.

In the previously described embodiment, a single pole double throw limit switch was utilized. This was dictated by the convenience of interrupting one circuit while establishing another by action of the cam surfaces 54 and 55. In this embodiment, each cycle is finished when the side of the switch controlling that circuit is opened and the other side of the switch is automatically closed in preparation for activation of the opposite action. Since each cycle is ended by the snap action of the switch when it disconnects one side to connect the opposite side, there is no possibility of mistaken actuation.

Figure 6:
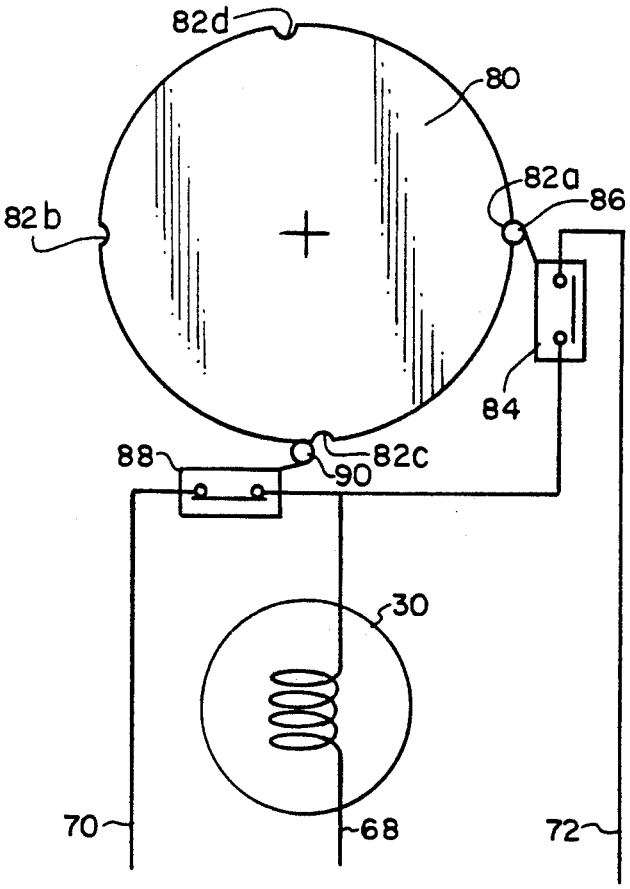
FIG. 6 is a schematic diagram showing an alternate embodiment of a drive disk and two micro switches which interact with the drive disk to control the operation of the motor.

In the alternate embodiment shown in FIG. 6, a different drive disk is utilized for the control of the motor circuit. In this configuration a drive disk 80 has four detents 82 cut into its peripheral edge. Detents 82*a* and 82*b* are diametrically opposed to each other and detents 82*c* and 82*d* are diametrically opposed to each other. However, the angle between the center of detents 82*a* and 82*c* is 85 degrees and the angle between the center of detents 82*b* and 82*c* is 95 degrees. In the same manner the angle between the center of 82*a* and 82*d* is 95 degrees and the angle between the center of detent 82*b* and 82*d* is 85 degrees.

A normally open electrical switch 84 is positioned such that its roller follower arm 86 is engaged in detent 82*a*. A second electrical switch 88 has its roller follower arm 90 disposed at 90 degrees with respect to roller follower arm 86. In this manner, with the switches being 90 degrees apart, at least one of the switches is always closed because of the offset in the angle of the detents 82. In operation, the common lead 68 always has 24 volts applied to it. The open lead 72 will always have power applied to it when the "damper open" position is desired. The close lead 70 always has power applied to it when the "damper closed" position is desired. In this embodiment, with both electrical switches 84 and 88 being closed most of the time, the possibility of the damper blade 14 getting trapped in an intermediate position is eliminated.

The materials from which the universal mounting bracket 20 are made could be metal or plastic which would allow the curved mounting portions 24 to flex against the sides of the various sizes and configurations of air ducts 12. The drive disk 46 and starwheel 56 can be molded out of plastic or cast in metal.

Thus, it is apparent that there have been provided, in accordance with the invention, a damper control mechanism for use with air conditioning systems that fully satisfies the objects aims, and advantages set forth above. While the invention has been described in conjunction with specific embodiments thereof, it is evident that many alternatives, modifications and variations will be apparent to those skilled in the ar in light of the foregoing description. Accordingly, it is intended to embrace all such alternatives, modifications, and variations as fall within the spirit and broad scope of the appended claims.

We claim:

1. An air control damper assembly for mounting in an air duct comprising:

a damper blade mounted on a blade shaft within the air duct, means for rotating the damper blade within the duct from an open position permitting air to flow through the air duct to a close position in which the air flow is restricted comprising: a motor and gear unit having a constant speed output shaft, a drive disk connected to the output shaft and driven in response to operation of the motor, the drive disk having a circumferential edge around its perimeter, a plurality of drive pins mounted adjacent to the circumferential edge and extending axially from the drive disk, a driven wheel having a plurality of radial slots extending from the circumference towards the center of the driven wheel, the driven wheel mounted for rotation and operatively connected to the blade shaft, and at least one drive pin engaging one of the radial slots as the drive disk is rotated causing the driven wheel and blade shaft to rotate at a non-constant speed having a high torque and low speed at the beginning and the end of the rotation from one position to the other and having a low torque and high speed in the middle of the rotation of the blade's travel between positions, means for locking the damper blade in the open and close positions, and control means for causing the means for rotating the damper blade to operate from one position to the other and for causing the means for rotating to stop when the open or close position is reached.

2. The air control damper of claim 1 wherein there are four equally spaced pins adjacent to the circumferential edge on the drive disk and four radial slots on the driven wheel, with one pin engaging its respective slot during 90 degrees rotation of the damper blade.

3. The air control damper of claim 2 wherein the engaging pin initially engages its respective radial slot while the slot's orientation is tangential to the path of the engaging pin, the engagement being substantially perpendicular to the path of the pin when the damper is midway between positions, and exiting when the slot's orientation is again tangential to the path of the pin when the open or close position is reached.

4. The air control damper assembly of claim 1 wherein the control means comprises at least one electrical switch having a control arm engaging the drive wheel, means on the drive wheel to operate the control arm and electrical switch in response to the position of the drive wheel, the electrical switch electrically connected to a control circuit which controls power to the motor, whereby the energization of the motor is at least partially controlled by the position of the drive wheel.

5. The air control damper assembly of claim 1 wherein the control means comprises at least two electrical switches having control arms engaging the drive wheel, means on the drive wheel to operate the control arms and electrical switches in response to the position of the drive wheel, the electrical switches electrically connected to a control circuit which controls power to the motor, whereby energization of the motor is at least partially controlled by the position of the drive wheel.

6. The air control damper assembly of claim 1 wherein the means for locking the damper blade in the open and close positions comprises the motor and gear unit, the output shaft being locked by the motor and gear unit when the motor is de-energized.

7. The air control damper assembly of claim 1 and further comprising a mounting bracket having a central flat mounting surface upon which is mounted the motor, gear unit, drive disk and driven wheel, the mounting bracket having a pair of flanges extending outward from the central flat surface, the flanges configured to be fastened by threaded fasteners to the air duct.

8. The air control damper assembly of claim 7 wherein the flanges are curved and have slots terminating at an outer edge of the flanges, the threaded fasteners positioned in the slots permitting the curved flanges to be mounted to various configured air ducts.

9. An air control damper assembly for mounting in an air duct comprising:

a damper blade mounted on a blade shaft, the blade shaft pivotally mounted in the air duct to allow the blade to rotate therein from an open position permitting air to flow through the air duct to a close position in which the air flow is restricted, a gearmotor assembly having an output shaft, a drive disk operatively connected to the output shaft and having a plurality of drive pins mounted adjacent the circumferential edge and extending axially from the drive disk, a driven starwheel having a plurality of radial slots extending from the circumference towards the center of the driven starwheel, the starwheel mounted for rotation and connected to the blade shaft, one of the drive pins engaging one of the radial slots as the drive disk is rotated by the gearmotor causing the driven starwheel and blade shaft to rotate at a non-constant speed having a high torque and low speed at the beginning and end of the rotation and low torque and high speed in the middle of the rotation of the damper blade's travel between the open and close positions, control means for turning the gearmotor on and off at selected times to move the damper blade between the open and close positions, and damper blade locking means for restraining the movement of the damper blade when the blade is in the desired position.

10. The air control damper assembly of claim 9 wherein there are four equally spaced pins adjacent to the circumferential edge on the drive disk and four radial slots on the driven wheel, one pin engaging its respective slot during 90 degrees rotation of the damper blade.

11. The air control damper assembly of claim 10 wherein the engaging pin initially engages its respective slot while the slot's orientation is tangential to the path of the engaging pin, the engagement being substantially perpendicular to the path of the pin when the damper is midway between positions, and exiting when the slot's orientation is again tangential to the path of the pin when the open or close position is reached.

12. The air control damper assembly of claim 9 wherein the control means comprises at least one electrical switch having a control arm engaging the drive wheel, means on the drive wheel to operate the control arm and electrical switch in response to the position of the drive wheel, the electrical switch electrically connected to a control circuit which controls power to the gearmotor, whereby the energization of the gearmotor is at least partially controlled by the position of the drive wheel.

13. The air control damper assembly of claim 9 wherein the control means comprises at least two electrical switches having control arms engaging the drive wheel, means on the drive wheel to operate the control arms and electrical switches in response to the position of the drive wheel, the electrical switches electrically connected to a control circuit which controls power to the gearmotor, whereby energization of the gearmotor is at least partially controlled by the position of the drive wheel.

14. The air control damper assembly of claim 9 wherein the damper blade locking means comprises the gearmotor, the output shaft being locked by the gearmotor when the gearmotor is deenergized.

15. The air control damper assembly of claim 9 and further comprising a mounting bracket having a central flat mounting surface upon which is mounted the gearmotor, drive disk and driven wheel, the mounting bracket having a pair of flanges extending outward from the central flat surface, the flanges configured to be fastened by threaded fasteners to the air duct.

16. The air control damper of claim 15 wherein the flanges are curved and have slots terminating at an outer edge of the flanges, the threaded fasteners positioned in the slots permitting the curved flanges to be mounted to various configured air ducts.

17. A non linear drive mechanism for controlling the position of a damper blade from an open to close position in an air control damper assembly comprising:

a gear and motor assembly having a constant speed output shaft, the output shaft assuming a locked position when the gear and motor assembly is inoperative, a drive disk operatively connected to the output shaft having a plurality of drive pins mounted adjacent to the circumferential edge of the disk and extending axially therefrom, a driven wheel operatively connected to the damper blade, the driven wheel having a plurality of radial slots extending from the circumference towards the center of the driven wheel, at least one drive pin on the drive disk engaging one of the radial slots on the driven wheel as the drive disk is rotated causing the driven wheel and blade shaft to rotate at a non-constant speed and having a high torque and low speed at the beginning and end of the movement between positions and a low torque and high speed as the damper blade moves through the middle of the blade's travel between positions, control means comprising at least one electrical switch having a control arm engaging the drive wheel, means on the drive wheel to operate the control arm and electrical switch in response to the position of the drive wheel, the electrical switch electrically connected to a control circuit which controls power to the motor, whereby the energization of the motor is at least partially controlled by the position of the drive wheel.

18. The drive mechanism of claim 17 wherein the motor is an alternating current motor which rotates the constant speed output shaft in one direction only resulting in the damper blade rotating in one direction.

* * * * *